United States Patent [19]

Hellblom et al.

[11] Patent Number: 4,757,237

[45] Date of Patent: Jul. 12, 1988

[54] ELECTRON CYCLOTRON RESONANCE NEGATIVE ION SOURCE

[75] Inventors: Göran Hellblom, Täby; Claude Jacquot, Aix en Provence, both of France

[73] Assignee: Commissariat a l'Energie Atomique, Paris, France

[21] Appl. No.: 849,489

[22] Filed: Apr. 8, 1986

[30] Foreign Application Priority Data

Apr. 11, 1985 [FR] France ..... 85 05461

[51] Int. Cl.[4] ..... H01J 7/24

[52] U.S. Cl. ..... 315/111.81; 315/111.21; 315/111.01; 313/231.31; 250/423 R

[58] Field of Search ..... 315/111.21, 111.31, 315/111.41, 111.61, 111.81; 250/423 R; 313/231.31

[56] References Cited

U.S. PATENT DOCUMENTS 4,417,178 11/1983 Geller et al. ..... 315/111.81

4,447,773 5/1984 Aston ..... 328/233

4,602,161 7/1986 Whealton et al. ..... 315/111.81 X

*Primary Examiner*—David K. Moore

*Assistant Examiner*—Mark R. Powell

*Attorney, Agent, or Firm*—Cesari and McKenna

[57] ABSTRACT

An electron cyclotron resonance negative ion source comprises an enclosure containing a gas or vapor of a material for forming a plasma, means for injecting into the enclosure a high frequency electromagnetic field forming electrons by ionizing the gas or vapor, means for producing within the enclosure an axially symmetric magnetic field whose amplitude increases along the axis of symmetry, whereby said amplitude, which is at a maximum in the vicinity of and upstream of the negative ion extraction zone, having in the central region of the enclosure a value for which the electron cyclotron resonance condition is satisfied, as well as means for extracting the negative ions formed, brought to a positive potential compared with the enclosure.

7 Claims, 1 Drawing Sheet

ELECTRON CYCLOTRON RESONANCE NEGATIVE ION SOURCE

BACKGROUND OF THE INVENTION

The present invention relates to an electron cyclotron resonance negative ion source. It is advantageously applied in the production of high intensity $H^-$ ion beams (above 1 A) or the $D^-$ or $T^-$ isotopes thereof, said beams mainly being used for producing high energy neutral atom beams (intensity of several dozen amperes and energy of 200 to 500 KeV), which are more particularly used as effective heating means for thermonuclear plasmas produced in magnetic confinement fusion means. Moreover, these high intensity $H^-$, $D^-$ or $T^-$ ion beams can be used in nuclear physics and in particular in tandem van der Graaf accelerators, or in the medical field using accelerators of the variable energy cyclotron type.

One of the presently used methods for producing negative ion beams and in particular $H^-$, $D^-$ and $T^-$ ions is volume ionization. This is based on the formation, from a gas or a vapor contained in a closed enclosure, of a plasma mainly constituted in the case of hydrogen by $H^-$ and $H^+$ ions and electrons.

This method firstly consists of producing molecules of hydrogen, deuterium or tritium, as a function of the starting gas used, which are vibrationally excited by hot or high energy electrons, i.e. having a kinetic energy above 20 eV, in accordance with the following reaction diagram (1) in the case of hydrogen:

$$e^- + H_2 \rightarrow e^- + H_2^* \quad (1)$$

Then, from the said ($H_2$) excited molecules are formed $H^-$, $D^-$ or $T^-$ ions by the following dissociative attachment reaction (2) in the case of hydrogen:

$$e^- + H_2^* \rightarrow H_2^- \rightarrow H^- + H \quad (2)$$

In this reaction diagram, the intermediate compound is unstable. The effective attachment cross-sections are high for co-called electrons having a kinetic energy at the most equal to 1 eV. This dissociative attachment phenomenon has in particular been described in an article by M. BACAL et al, *Phys. Rev. Letters*, 42, 1538, 1979.

The difficulty in such an enclosure of producing negative ions is linked with the production in the closed enclosure of the ion source a population of high energy or hot electrons and a population of cold electrons, which are spatially separated in such a way that the hot electrons do not destroy the negative ions formed by a collision which, in the case of hydrogen, is of the type:

$$H^- + e^- \rightarrow H + 2e^- \quad (3)$$

However, in the known negative ion sources functioning on the aforementioned principle, the destruction of the negative ions formed by reaction with the hot electrons of the plasma is relatively significant, which is prejudicial to the production of an intense negative ion beam. Generally, the number of negative ions constituting the plasma produced in the enclosure only represents 10% of the number of positive ions.

Moreover, in negative ion sources produced from a plasma, there is another problem linked with the method of extracting the negative ions by the electrostatic or ambipolar effect. Thus, the extraction or discharge by electrostatic effect of particles (positive ions, electrons, etc.) in a random particle source is always carried out by means of extraction electrodes raised to a positive potential compared with the walls of the enclosure formed, which is due to the high mobility of the plasma electrons. However, although for the extraction of positive ions, said positive potential aids the extraction, in the case of negative ions, said potential prevents the negative ions from leaving and electrostatically confines them in the enclosure. This is prejudicial to the production of an intense negative ion beam.

SUMMARY OF THE INVENTION

The present invention relates to a negative ion source making it possible to obviate the aforementioned disadvantages. It more particularly makes it possible to produce an intence negative ion beam, especially of $H^-$, $D^-$ or $T^-$ ions using as the physical phenomena the dissociative attachment method, as well as electron cyclotron resonance. This resonance phenomena is generally used for producing multicharged positive ions. European patent application No. 0127523 filed in the name of the present Applicant describes a positive ion source operating on the principle of electron cyclotron resonance.

More specifically, the present invention relates to a negative ion source comprising a closed enclosure containing a gas or vapor of a material intended for forming a plasma, wherein it comprises means for injecting into the enclosure a high frequency electromagnetic field forming electrons by the ionization of the gas or vapor, means for producing within the enclosure a magnetic field of axial symmetry, whose amplitude increases along the axis of symmetry, said amplitude, which is at a maximum in the vicinity of and upstream of the negative ion extraction zone having in the central region of the enclosure a value for which the electron cyclotron resonance condition is satisfied and means for extracting the negative ions formed raised to a positive potential compared with the enclosure.

The use of an ultra-high or high frequency electromagnetic field makes it possible to ionize the molecules of gas or vapor contained in the enclosure by energy transfer. The thus formed electrons are subject to the action of the axial symmetry magnetic field which, as a result of the cyclotron absorption mechanism, are highly accelerated in the central region of the enclosure where the magnetic field has an amplitude $B_R$ defined by the equation (4): $B_R = 2\pi \cdot fm/e$, in which e represents the electron charge, m its mass and f the frequency of the electromagnetic field.

This electron cyclotron resonance condition makes it possible to produce high energy or hot electrons having a kinetic energy exceeding 20 eV in a direction perpendicular to the magnetic field. These hot electrons, by collision with the molecules of the gas or vapor contained in the source, produce other electrons, which will also be accelerated by cyclotron resonance. The thus formed hot electron plasma makes it possible, in accordance with reaction mechanism (1), to excite the molecules of the gas or vapor.

Outside the resonance zone, the electrons formed by the interaction of the electromagnetic wave and molecules of gas or vapor have a lower energy, e.g. at the most equal to 1 eV. These cold electrons interact with the non-excited neutral molecules of gas or vapor, thus forming positive ions and other cold electrons, so that a cold electron plasma is formed. Bearing in mind the profile of the amplitude of the magnetic field, this cold electron plasma is mainly located in the negative ion extraction zone. This cold plasma of electrons makes it possible, in accordance with reaction mechanism (2), to form negative ions.

The negative ion source according to the invention permits the formation of a hot electron plasma and a cold electron plasma, which are well spatially separated, so that it is possible to form negative ions and in particular $H^-$, $D^-$ or $T^-$ ions by dissociative attachment and by electron cyclotron resonance, whilst preventing the destruction of the negative ions formed by collisions with the high energy electrons, in accordance with reaction mechanism (3).

The thus formed negative ions extracted from the plasma could advantageously be accelerated by using appropriate means located downstream of the extraction means. This final acceleration of the ions can, e.g., be obtained using an electrode, perforated with one or more openings so as to permit the passage of the ions and brought to a positive potential compared with that of the extraction means.

According to a preferred embodiment of the ion source according to the invention, it is possible to provide means for reducing the amplitude of the magnetic field level with the extraction means for the ions. This local cancelling out of the amplitude of the magnetic field can advantageously be realized by using as the negative ion extraction means, an electrode or plate made from a ferromagnetic substance, perforated with slots or holes to permit the passage of the negative ions formed.

This cancelling out of the amplitude of the magnetic field level with the extraction of the ions brings about a trapping of the electrons which have not reacted with the gas or vapor molecules, thus making it possible to prevent their acceleration between the extraction and acceleration means and consequently their removal from the source.

According to another preferred embodiment of the ion source according to the invention, the electromagnetic field injection means comprise a waveguide, whereof one end, mounted on the enclosure, is equipped with a dielectric material window.

BRIEF DESCRIPTION OF THE DRAWINGS

The invention is described in greater detail hereinafter relative to non-limitative embodiments and the attached drawings, wherein show.

Figure 1:
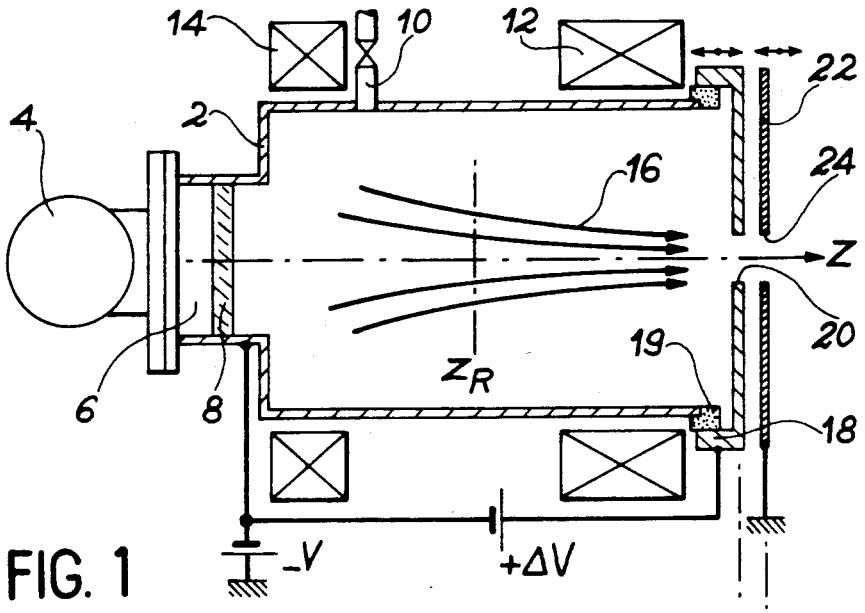
FIG. 1: diagramatically and in longitudinal section, a negative ion source according to the invention.

On referring to FIG. 1, it can be seen that the negative ion source according to the invention comprises a confinement vacuum enclosure 2 constituting a resonant cavity, which can be excited by an ultra-high frequency electromagnetic field. Enclosure 2 has an axis of symmetry Z which, in the case of a cylindrical enclosure, represents the axis of revolution. The electromagnetic wave produced by a source 4 such as a klystron is introduced into resonant cavity 2 by means of a waveguide 6, having a circular or rectangular cross-section and provided at its end mounted on the enclosure with a window 8 made from a dielectric material, such as $Al_2O_3$. This wave can be pulsating or continuous and have a frequency between 1 and 100 GHz.

A duct 10 makes it possible to introduce a gas or a vapour of a material into the cavity 2 for forming a plasma therein. Advantageously, this introduction of gas is carried out in the vicinity of the introduction of the electromagnetic wave. For example, enclosure 2 can be filled with hydrogen, deuterium or tritium at a pressure of 1 to 10 mtorr (1.34 Pa).

Not shown means, such as a cryogenic or diffusion pump, mounted on cavity 2 make it possible to maintain a hard vacuum within the cavity.

Cavity 2 is raised to an electrostatic potential $-V$ with respect to earth. It is also surrounded by two coils 12, 14, coil 12 being supplied in counter-field, making it possible to produce a magnetic field of axial symmetry. In particular, the axis of symmetry of this magnetic field can coincide with the axis of symmetry Z of cavity 2. Arrows 16 represent the field lines of the magnetic field, which can either be continuous or pulsating.

The negative ion source according to the invention also comprises means making it possible to extract the ions formed. These means are, e.g., constituted by a conductive plate 18 raised to a positive potential compared with enclosure 2, e.g. to a potential $-V+\Delta V$. They are mounted on one of the ends of the enclosure and insulated therefrom by an insulating ring 19. Means 18 are equipped with at least one hole or slot 20 permitting the passage of the negative ions. This extraction opening 20 is, e.g., located on the axis of symmetry Z of the ultra-high frequency cavity.

The value for V and $\Delta V$ is chosen as a function of the gas or vapor used. For example, for hydrogen or its isotopes V can be between $-1500$ and $-2000V$ and $\Delta V$ can be between 5 and 20 volts.

According to the invention, the negative ion extraction electrode 18 can be followed by another electrode 22 brought to a positive potential compared with the extraction electrode 18 and, e.g. at earth potential, in order to accelerate negative ions formed to their final value. Electrode 22 is obviously equipped with at least one opening 24, particularly located on the axis of symmetry Z of the cavity, thus permitting the passage of the negative ions formed out of the source. The positions of the extraction and acceleration electrodes 18, 20 respectively are advantageously regulatable along axis Z.

As shown in FIG. 1, the electromagnetic waveguide 6 and the extraction and acceleration electrodes 18, 22 of the ion source are disposed at two opposite ends of resonant cavity 2. The axis of symmetry of waveguide 6 and those of openings 20, 24, reciprocally made in electrodes 18, 22 coincide with the axis of symmetry Z of the cavity.

Figure 2:
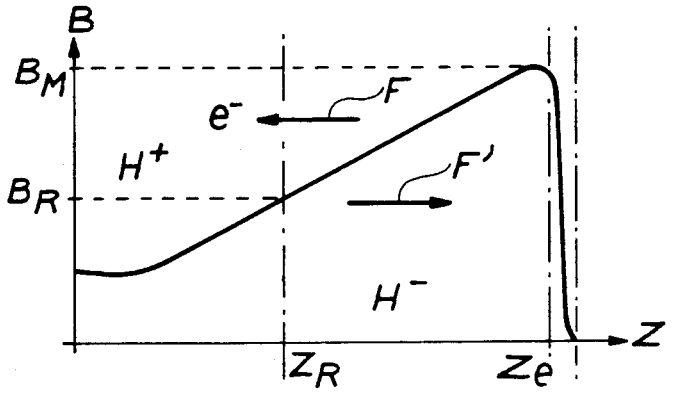
FIG. 2: a curve giving the amplitude B of the magnetic field prevailing in the source of FIG. 1, as a function of the distance Z on the axis of revolution of the source.

Coils 12 and 14 surrounding cavity 2 permit, in the manner shown in FIG. 2, the creation of a magnetic field of axial symmetry in the enclosure, whose amplitude B increases from the window 8 of the electromagnetic wave injector to the extraction electrode 18. At a point $Z_R$ taken on the axis of symmetry of cavity 2 and approximately in the center of the latter, said magnetic field has an amplitude $B_R$ satisfying the electron cyclotron resonance condition(4), thus permitting the formation of high energy $e^-$ electrons used for the vibrational excitation of the molecules of the gas contained in enclosure 2. Moreover, said magnetic field has an amplitude maximum $B_M$ just upstream of the extraction electrode 18, whose position is designated by the reference $Z_e$.

In view of the high coupling between the electromagnetic wave and the electrons produced by ionization at $Z_R$, the electrons acquire a high kinetic energy perpendicular to the magnetic field. In the magnetic field, whose amplitude increases towards electrode 18, said electrons are subject to a mirror effect and to a force $\vec{F}=e\vec{E}=\mu$ grad $\vec{B}$, $\mu$ being the magnetic moment of the *electron. Thus, they are accelerated towards the window 8 of the electromagnetic injector. The displacement direction of these electrons is illustrated by arrow F.*

Figure 3:
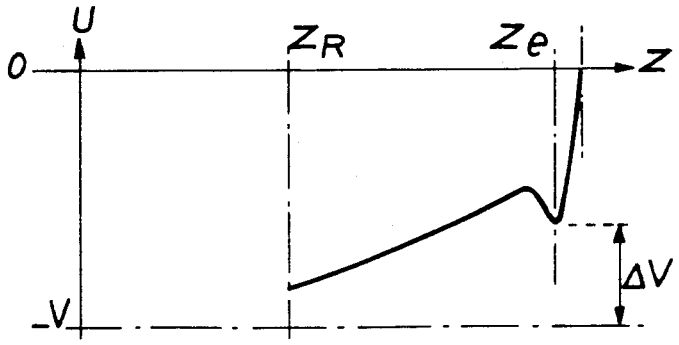
FIG. 3: A curve giving the variations of the electrical potential U within the source as a function of the distance Z.

In their axial drag, the high energy electrons, as a result of the electrostatic or ambipolar effect, drag the positive ions such as $H^+$, $D^+$ or $T^+$ formed during the ionization of the hydrogen, deuterium or tritium gas contained in enclosure 2. As shown in FIG. 3, this leads to a co-called more positive plasma potential towards extraction electrode 18 ($Z_e$) than in the center of the cavity ($Z_R$). This more positive potential is responsible for the autoacceleration of the $H^-$ ions, represented by arrow $F_1$, said ions being produced in the ion extraction zone, i.e. in the vicinity of and upstream of electrode 18.

The negative ions and e.g. $H^-$, $D^-$ or $T^-$ ions are preferably produced in the ion extraction region, due to the fact that the vibrationally excited gas molecules of equation (1) are insensitive to the magnetic field, so that they can diffuse isotropically.

In view of the very slightly positive polarity $+\Delta V$ of the extraction electrode 18 relative to the ultra-high frequency cavity 2, it is easier to extract from the plasma the negative ions formed, e.g. $H^-$ in the case of hydrogen.

As shown in FIG. 2, the amplitude of the magnetic field can be advantageously cancelled out at the extraction electrode 18, e.e. at $Z_e$, in order to bring about a trapping of the electrons of the plasma, so as to make it possible to avoid their acceleration between the extraction electrode 18 and electrode 22. This cancelling out of the magnetic field can e.g. be obtained by using an extraction electrode 18 made from a ferromagnetic substance.

The negative ion source according to the invention has made it possible to produce a $H^+$ ion beam having an energy of 2 KeV per nucleon and an intensity of 10 mA using a mean ultra-high frequency power of 1 kW, an electron cyclotron frequency of 10 GHz and a magnetic field with an amplitude increasing from 0.2 to 0.45 T. The ion source had a cylindrical cavity of diameter 10 cm and length 15 cm and was brought to a negative potential of −2000 volts and the extraction electrode 18 to a potential 2 volts higher than that of the cavity, i.e. −1998V. The pressure of the hydrogen gas contained in the enclosure was 0.2 Pa.

The above description has obviously been given in a non-limitative, illustrative manner and any modification can be made thereto without passing beyond the scope of the invention.

In particular, it is possible to use different means for extracting the negative ions and for cancelling out the amplitude of the magnetic field at said extraction means, instead of using a single means for performing both functions. For example, it is possible to use ferrites for reducing the amplitude of the magnetic field.

Moreover, the axial symmetry magnetic field can be produced by ferrites instead of using two coils supplied in counter-field and surrounding the ultra-high frequency cavity. In the same way, the cavity can have a shape other than cylindrical and can e.g. be parallelepipedic.

Finally, the description has been made in the case of producing $H^-$, $D^-$ or $T^-$ ions, but obviously the source according to the invention can also produce other types of negative ions and in particular oxygen, sodium, lithium and iodine ions.

What is claimed is:

1. A negative ion source comprising an enclosure containing a gas or vapor of a material intended for forming a plasma, said source comprising means for injecting into the enclosure along an axis a high frequency electromagnetic field that forms electrons by the ionization of the gas or vapor, means for producing within the enclosure a magnetic field that is symmetric about said axis and whose amplitude increases continually along said axis and has, in the central region of the enclosure, a value for which the electron cyclotron resonance condition is satisfied so that an electron plasma is produced in said region, negative ion extraction means located downstream from said central region, said extraction means defining an extraction zone in the vicinity of which said magnetic field amplitude is at a maximum, and means for raising said extraction means to a positive potential as compared with said enclosure so that negative ions are formed in and extracted from the enclosure outside of the plasma.

2. A negative ion source according to claim 1, wherein it comprises, downstream of the extraction means, means for accelerating the negative ions formed.

3. A negative ion source according to claim 1, wherein it comprises means for cancelling out the amplitude of the magnetic field at the ion extraction means.

4. A negative ion source according to claim 3, wherein the cancelling means and extraction means coincide, said extraction means being formed by a ferromagnetic material plate perforated with at least one opening to permit the passage of the ions.

5. A negative ion source according to claim 2, wherein the acceleration means are formed from an electrode brought to a positive potential compared with that of the extraction means and provided with at least one opening to permit the passage of the ions.

6. A negative ion source according to claim 1, wherein the means for injecting the electromagnetic field comprise a waveguide, the end of which is mounted on the enclosure is equipped with a dielectric material window.

7. A negative ion source according to claim 1, wherein the gas is hydrogen or isotopes thereof.

* * * * *